US006570502B2

(12) United States Patent
Matsuo

(10) Patent No.: US 6,570,502 B2
(45) Date of Patent: May 27, 2003

(54) SHOPLIFTING MONITORING APPARATUS AND ATTACHMENT UNIT

(75) Inventor: Toichiro Matsuo, Arao (JP)

(73) Assignee: Matsuo Sangyo Kabushiki Kaisha, Omuta (JP)

( * ) Notice: Subject to any disclaimer, the term of this patent is extended or adjusted under 35 U.S.C. 154(b) by 0 days.

(21) Appl. No.: 09/943,025

(22) Filed: Aug. 31, 2001

(65) Prior Publication Data

US 2002/0196143 A1 Dec. 26, 2002

(30) Foreign Application Priority Data

Jun. 22, 2001 (JP) ..... 2001-189421
Jul. 18, 2001 (JP) ..... 2001-218610

(51) Int. Cl.[7] ..... G08B 13/14
(52) U.S. Cl. ..... 340/568.2; 340/568.1; 340/568.4; 340/568.8; 340/571; 340/572.8
(58) Field of Search ..... 340/568.2, 568.1, 340/568.3, 568.4, 568.8, 571, 572.8, 572.9; 248/551; 70/57.1, 58

(56) References Cited

U.S. PATENT DOCUMENTS 5,072,213 A * 12/1991 Close ..... 340/572.1
5,146,205 A * 9/1992 Keifer et al. ..... 340/568.1
5,341,124 A * 8/1994 Leyden et al. ..... 340/568
5,861,807 A * 1/1999 Leyden et al. ..... 340/568
6,027,277 A * 2/2000 Leyden et al. ..... 403/291
6,037,867 A * 3/2000 Joseph et al. ..... 340/508
6,039,498 A * 3/2000 Leyden et al. ..... 403/61

FOREIGN PATENT DOCUMENTS

JP 2000-357278 12/2000
NZ 200666 2/1985

* cited by examiner

*Primary Examiner*—Toan Pham

(57) ABSTRACT

Disclosed are a shoplifting monitoring apparatus and an attachment unit.

The shoplifting monitoring apparatus includes the attachment unit and an alarm device.

The attachment unit has an attachment surface to be attached to an article. The attachment unit includes a detection element for detecting whether the attachment unit is attached to the article or not. The attachment unit is provided at the attachment surface with a first portion screw-fittable onto a screw of the article. The attachment unit can be attached to the article by screw-fitting the first portion of the attachment unit onto the screw of the article.

The alarm device issues an alarm based on information indicating that the attachment unit is not attached to the article, the information being detected by the detection element.

22 Claims, 11 Drawing Sheets

SHOPLIFTING MONITORING APPARATUS AND ATTACHMENT UNIT

CROSS-REFERENCE TO RELATED APPLICATIONS

This application is based on Japanese Patent Applications No. 2001-189421 filed in Japan on Jun. 22, 2001, and No. 2001-218610 filed in Japan on Jul. 18, 2001, the entire contents of which are hereby incorporated by reference.

BACKGROUND OF THE INVENTION

1. Field of the Invention

The present invention relates to a shoplifting monitoring apparatus for preventing or deterring an article (monitoring target article) or goods from being shoplifted.

The present invention also relates to an attachment unit that is utilized in the shoplifting monitoring apparatus and to be attached to the monitoring target article.

2. Description of Related Art

A wide variety of shoplifting monitoring apparatus have been proposed for preventing or deterring an article (goods), e.g., on display in a shop, from being shoplifted.

For example, such a shoplifting monitoring apparatus has been proposed with which shoplifting of the article is detected in the following manner, and an alarm is issued when shoplifting of the article is detected.

For example, such an attachment unit described below is to be attached to the article. The attachment unit has a detection element for detecting whether the attachment unit is attached to the article or not. In accordance with an attached state of the attachment unit to the article detected by the detection element, the alarm is issued. The attachment unit is to be attached to the article with, e.g., a double-sided adhesive tape. As the detection element, employed is, e.g., a switch having a contact that opens or closes in accordance with the attached state of the attachment unit to the article.

If the attachment unit is attached to the article with the double-sided adhesive tape, however, such a problem may arise in some cases. For example, it is difficult to attach the attachment unit to the article with the double-sided adhesive tape in some cases, which depends on a surface condition of the article. The double-sided adhesive tape make the article dirty in some cases. If the attachment unit is attached to and removed from the article in a number of times, the adhesion force of the double-sided adhesive tape would lower, the attachment unit therefore cannot be attached to the article at last in some cases. If the attachment unit is attached to the article for a long time, the adhesion force of the double-sided tape would lower, the attachment unit is therefore removed or separated from the article in some cases.

SUMMARY OF THE INVENTION

It is an object of the invention to provide a shoplifting monitoring apparatus in which an attachment unit is to be attached to the monitoring target article, and an alarm is issued in accordance with the attached state of the attachment unit to the article, and more particularly to provide the shoplifting monitoring apparatus in which the attachment unit can be attached to the monitoring target article easily and precisely.

It is another object of the invention to provide an attachment unit which is utilized in the shoplifting monitoring apparatus, and can be attached to the monitoring target article easily and precisely.

(1) Shoplifting Monitoring Apparatus

The invention provides a shoplifting monitoring apparatus comprising:

an attachment unit having an attachment surface to be attached to an article, the attachment unit including a detection element for detecting whether the attachment unit is attached to the article or not; and an alarm device issuing an alarm based on information indicating that the attachment unit is not attached to the article, the information being detected by the detection element; wherein the attachment unit is provided at the attachment surface with a first portion screw-fittable onto a screw of the article; and the attachment unit can be attached to the article by screw-fitting the first portion of the attachment unit onto the screw of the article.

(2) Attachment Unit

The invention also provides an attachment unit utilized in a shoplifting monitoring apparatus and having an attachment surface to be attached to an article, the attachment unit comprising:

a detection element for detecting whether the attachment unit is attached to the article or not; and a first portion screw-fittable onto a screw of the article and arranged at the attachment surface; wherein the attachment unit can be attached to the article by screw-fitting the first portion of the attachment unit onto the screw of the article.

The foregoing and other objects, features, aspects and advantages of the present invention will become more apparent from the following detailed description and the accompanying drawings.

DESCRIPTION OF THE PREFERRED EMBODIMENTS

§1. Shoplifting Monitoring Apparatus

Figure 1:
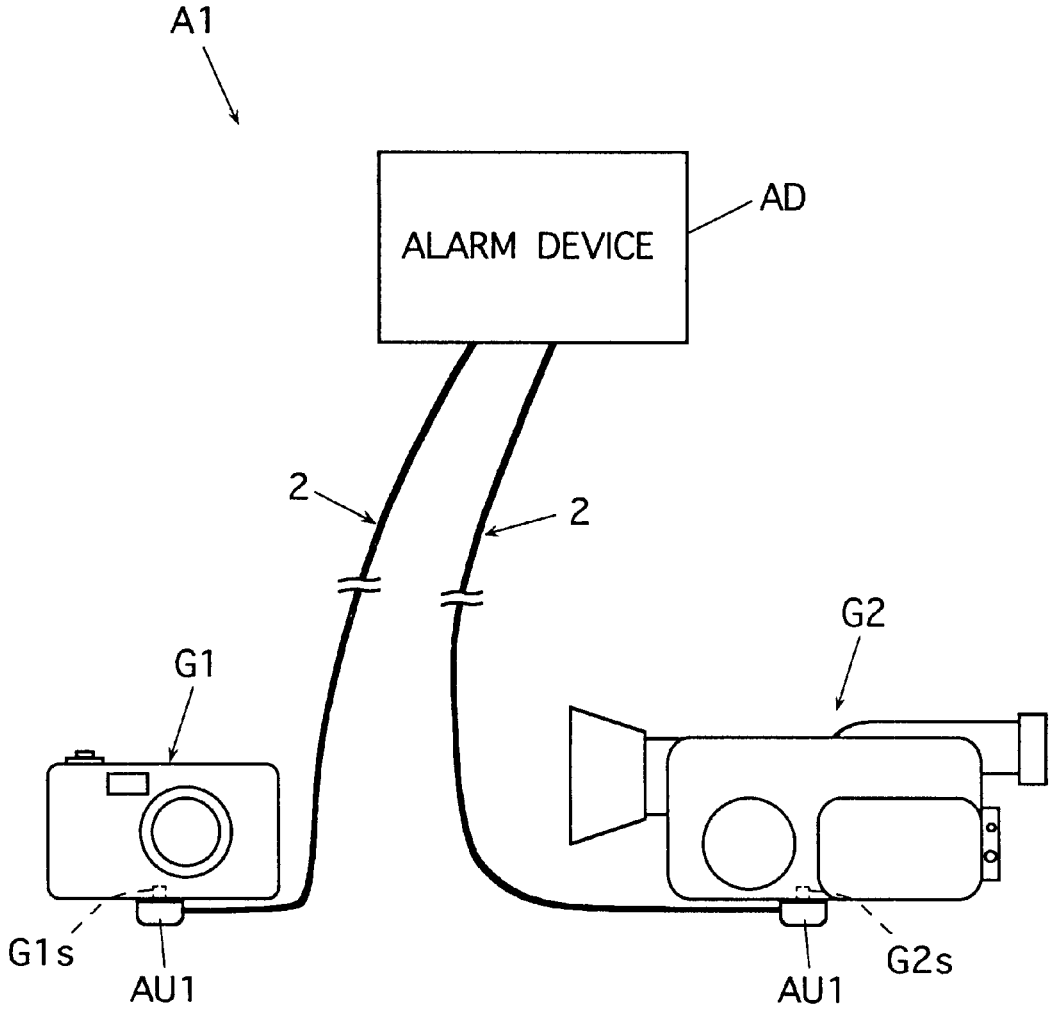
FIG. 1 is a schematic view showing a structure of an example of the shoplifting monitoring apparatus according to the invention.

In the following description, a shoplifting monitoring apparatus having advantages described later is presented.

§1.1.

The shoplifting monitoring apparatus is provided with an attachment unit and an alarm device.

The attachment unit is to be attached to an article (monitoring target article) to be monitored not for being shoplifted. A predetermined surface of the attachment unit is to be attached to the monitoring target article. More specifically, the attachment unit is to be attached to the monitoring target article such that the predetermined surface of the attachment unit faces the article. This predetermined surface of the attachment unit is referred to as "attachment surface" hereinafter.

The attachment unit includes a detection element for detecting an attached state of the attachment unit to the monitoring target article, that is, whether the attachment unit is attached to the article or not. The attachment unit may further include a hollow casing (cover casing), in which case at least a part of the detection element may be arranged inside the casing.

The detection element may be such a switch as follows. The switch has a movable piece and a contact. The contact selectively takes an open or closed state in accordance with a position of the movable piece, more specifically, in accordance with the position of the movable piece with respect to a body of the switch. The movable piece is biased toward an outside of the attachment surface, typically the movable piece is biased to be pushed toward the outside of the attachment surface. The outside and inside of the attachment surface are sides of the attachment surface nearer to and remoter from the article, respectively, when the attachment unit is attached to the article.

The movable piece may be biased toward the outside of the attachment surface, e.g., with an elastic member. The elastic member may be a spring such as a coiled spring or plate spring (leaf spring), or a rubber member. The movable piece may have a rod-like form, and may be configured to move linearly between the inside and outside of the attachment surface. Instead of this, the movable piece may be configured to swing around a predetermined axis between the inside and outside of the attachment surface.

The contact of the switch takes the closed state when the movable piece is pushed toward the inside of the attachment surface so that the movable piece is located or positioned at an inside of a standard position (reference position). On the other hand, the contact of the switch takes the open state when the movable piece is positioned at the standard position or at an outside of the standard position. When attaching the attachment unit to the article, the movable piece is pushed by the article toward the inside of the attachment surface, and thereby the movable piece is positioned at the inside of the standard position to close the contact of the switch. If the attachment unit, that has been thus attached to the article, is removed from the monitoring target article, the force pushing the movable piece toward the inside of the attachment surface comes not to act on the movable piece so that the movable piece moves to the standard position or to the outside of the standard position due to the biasing force, and thereby the contact of switch becomes open. According to these, the switch can detect whether the attachment unit is attached to the monitoring target article or not.

Instead of the above switch, the detection element may be a photo-sensor to face the monitoring target article when the attachment unit is attached to the article. The photo-sensor can detect whether the attachment unit is attached to the article or not, for example, in the following way. The attachment unit is attached to the article such that a light-receiving portion of the photo-sensor can detect a light emitted from a light-emission portion of the photo-sensor and reflected by the article surface. If the attachment unit is removed from the article after thus attaching the attachment unit to the article, luminous intensity, amount and others of the light received by the light-receiving portion of the photo-sensor would be changed, so the attached state of the attachment unit can be detected by the photo-sensor.

The alarm device issues the alarm based on information detected by the detection element. More specifically, the alarm device issues the alarm based on the detection information indicating that the attachment unit is not attached to the article. The detection information indicating that the attachment unit is not attached to the article includes information indicating that the attachment unit is completely removed or apart from the article, and may further include information indicating that the attached state of the attachment unit to the article is not a normal state although the attachment unit is still partially attached to the article since the situation is that the attachment unit is likely to be removed from the article. The alarm device may issue the alarm at least when the removal of the attachment unit from the article is detected by the detection element. The alarm device may continue to issue the alarm even if the attachment unit is attached to the article again after detection of removal of the attachment unit from the article. If the switch is employed as the detection element, the alarm device may issue the alarm at least when the contact of the switch is in the open state.

The alarm issued out from the alarm device may be sound, light and/or others. The alarm device may include a buzzer issuing sound as the alarm, a lamp issuing light as the alarm and/or others. The alarm element such as buzzer and lamp may be arranged at the attachment unit.

§1.2.

In the shoplifting monitoring apparatus, the attachment unit further includes a first portion as follows.

The first portion of the attachment unit is provided for attaching the attachment unit to the monitoring target article. The first portion of the attachment unit is screw-fittable onto a screw of the article. The first portion is referred to as "screw portion" hereinafter.

In the case where the monitoring target article has a female screw, the screw-portion of the attachment unit is a male screw that is screw-fittable onto the female screw of the article. In the case where the article has a male screw, the screw portion of the attachment unit is a female screw that is screw-fittable onto the male screw of the article.

The attachment unit is to be attached to the monitoring target article by screw-fitting or screw-engaging the screw portion of the attachment unit onto the screw of the article.

Examples of the article having the screw may be a camera (including digital camera) and video camera (including digital video camera), although not restricted to those. Many kinds of the cameras and video cameras have screws (typically female screws) each for connecting a tripod to the camera or video camera for supporting it. If the attachment unit has the screw portion (typically male screw) that is screw-fittable onto the screw, provided originally for connecting the tripod, of the camera or video camera, the attachment unit can be attached easily to the article (camera or video camera). In this case, the shoplifting monitoring apparatus can be utilized for monitoring the camera or video camera.

By screw-fitting the screw portion of the attachment unit onto the screw of the monitoring target article as described above, the attachment unit is attached to the article, which provides easy attaching of the attachment unit to the article. The attaching of the attachment unit does not make the article dirty since the attachment unit is not attached with the double-sided adhesive tape. The attached state or condition of the attachment unit to the monitoring target article is hard to change even if the attachment unit is attached to the article for a long time. The attachment unit can be attached to the monitoring target article easily without fail even when the attachment unit is attached to the article again after the attachment unit is removed from the article. The attachment unit can be attached to the monitoring target article without fail even after the attachment unit is attached to and removed from the article in a number of times. The attachment unit is hard to be removed or separated from the monitoring target article even when the article is taken up by hand.

§1.3.

Further description is given below on the shoplifting monitoring apparatus.

(a) In the case where the article has the female screw, the screw portion of the attachment unit may be the male screw (male screw portion) screw-fittable onto the female screw of the article as described above.

In this case, the male screw of the attachment unit may have an aperture extending along a longitudinal direction (axis direction) of the male screw of the attachment unit, and at least a part of the foregoing switch as the detection element may be arranged inside the aperture of the male screw, and further the movable piece of the switch may be configured to move inside the aperture of the male screw. According to the above, when the attachment unit is attached to the article, the movable piece is pushed toward the inside of the attachment surface by a bottom surface of a hole (hole provide with a female screw thread at its inner surface) of the female screw of the article, and thereby the movable piece can be positioned at the inside of the standard position.

According to the above, an end portion of the movable piece of the switch is located inside the screw hole of the article when the attachment unit is attached to the article.

Such a situation can be therefore suppressed that, after the attachment unit is attached to the monitoring target article, the movable piece is held by a thin plate or the like, and thereby the movable piece cannot move to the standard position or outside thereof. That is, such a situation can be suppressed that the movable piece is held and thereby the contact of the switch does not become open, and more specifically, thereby the alarm is not issued from the alarm device. Consequently, the attached state of the attachment unit to the monitoring target can be detected accurately and precisely by the switch.

In the case where the movable piece of the switch is arranged inside the aperture of the male screw of the attachment unit as described above, structure and others described in the following item (a1) or (a2) may be further employed.

(a1) The attachment unit may further include an extension rod moving together with the movable piece of the switch, and the movable piece may be pushed via the extension rod toward the inside of the attachment surface when the attachment unit is attached to the article.

Length of the movable piece of a commercially available switch is usually not so long, and the movable piece is, therefore in some cases, not pushed toward the inside of the attachment surface even when the attachment unit is attached to the article if the female screw hole of the article is deep, and thereby the contact of the switch cannot be closed in some cases. Even in the case where the screw hole of the article is deep, by employing the extension rod as described above, the movable piece can be pushed via the extension rod toward the inside of the attachment surface so that the contact of the switch can be closed.

The extension rod may be arranged at the end portion, to face the article, of the movable piece. The movable piece and extension rod may be connected directly or indirectly to each other, e.g., with an adhesive material such that the movable piece and extension rod can move together with each other.

(a2) The attachment unit may further include an elastic member that moves together with the movable piece of the switch, and the movable piece may be pushed via the elastic member toward the inside of the attachment surface when the attachment unit is attached to the article.

According to the above, the attachment unit can cope with a number of kinds of articles having the screw holes of different depths since the elastic member, having elasticity, expands and contracts in accordance with the depth of the screw hole of the article.

The elastic member may be a spring such as coiled spring, or rubber member. The elastic member may be arranged at the end portion, to face the article, of the movable piece of the switch. The movable piece and elastic member may be connected directly or indirectly to each other, e.g., with an adhesive material such that the movable piece and elastic member can move together with each other. In the case where the movable piece is biased toward the outside of the attachment surface by the spring (referred to as first spring), and further a second spring moving together with the movable piece is provided at the attachment unit, spring modulus of the second spring may be larger than that of the first spring.

(b) In the case where the screw portion of the attachment unit is the male screw, and the male screw of the attachment unit has the aperture extending along the longitudinal direction of the male screw, at least a part of the switch may be arranged inside the aperture of the male screw.

In the above structure, the switch itself may be configured to move inside the aperture of the male screw of the attachment unit, and the switch itself may be biased toward the outside of the attachment surface. The switch may be biased toward the outside of the attachment surface, e.g. with an elastic member. The elastic member may be a spring such as coiled spring and plate spring, or rubber member. The movable piece of the switch may be typically pushed toward the inside of the attachment surface directly by the article when the attachment unit is attached to the article.

According to the above, the attachment unit can cope with a number of kinds of articles having the screw holes of different depths since the elastic member expands and contracts in accordance with the depth of the screw hole of the article. In the case where the movable piece of the switch is biased toward the outside of the attachment surface by the spring (referred to as first spring), and the switch itself is also biased toward the outside of the attachment surface by a second spring, spring modulus of the second spring may be larger than that of the first spring.

(c) The screw portion of the attachment unit may be screw-threaded from beginning so that the screw portion is screw-fittable onto the screw of the article.

Instead of this, the screw portion of the attachment unit may be screw-threaded by the screw of the article when the screw portion of the attachment unit is firstly attached to the article so that the screw portion of the attachment unit becomes screw-fittable onto the screw of the article. From this point of view, it can be considered that the screw portion (first portion) of the attachment unit is a portion or a member that is screw-fittable to the screw of the article. According to the above, the attachment unit can be attached to the article by screw-fitting the screw portion of the attachment unit onto the screw of the article, independently of pitch and others of the screw of the article.

(d) The structures, manners and others described above may be employed in combination.

§2. Attachment Unit

In the following description, an attachment unit utilized in the shoplifting monitoring apparatus is presented.

The attachment unit is as follows: an attachment unit utilized in a shoplifting monitoring apparatus and having an attachment surface to be attached to an article, the attachment unit comprising:

a detection element for detecting whether the attachment unit is attached to the article or not; and a first portion screw-fittable onto a screw of the article and arranged at the attachment surface; wherein the attachment unit can be attached to the article by screw-fitting the first portion of the attachment unit onto the screw of the article.

The matter described in the section §1. in relation to the attachment unit is also true of the above attachment unit. This attachment unit can be attached to the monitoring target article easily without fail.

The attachment unit may further include a cord (cable) for sending the information detected by the detection element to the alarm device.

§3.

With reference to drawings, the preferred embodiments of the shoplifting monitoring apparatus and the attachment unit are given below.

FIG. 1 is a schematic view showing a structure of an example of the shoplifting monitoring apparatus.

A shoplifting monitoring apparatus A1 shown in FIG. 1 has an alarm device AD and attachment units (attachment portions) AU1. The apparatus A1 has two attachment units AU1 in this example.

Figure 2A:
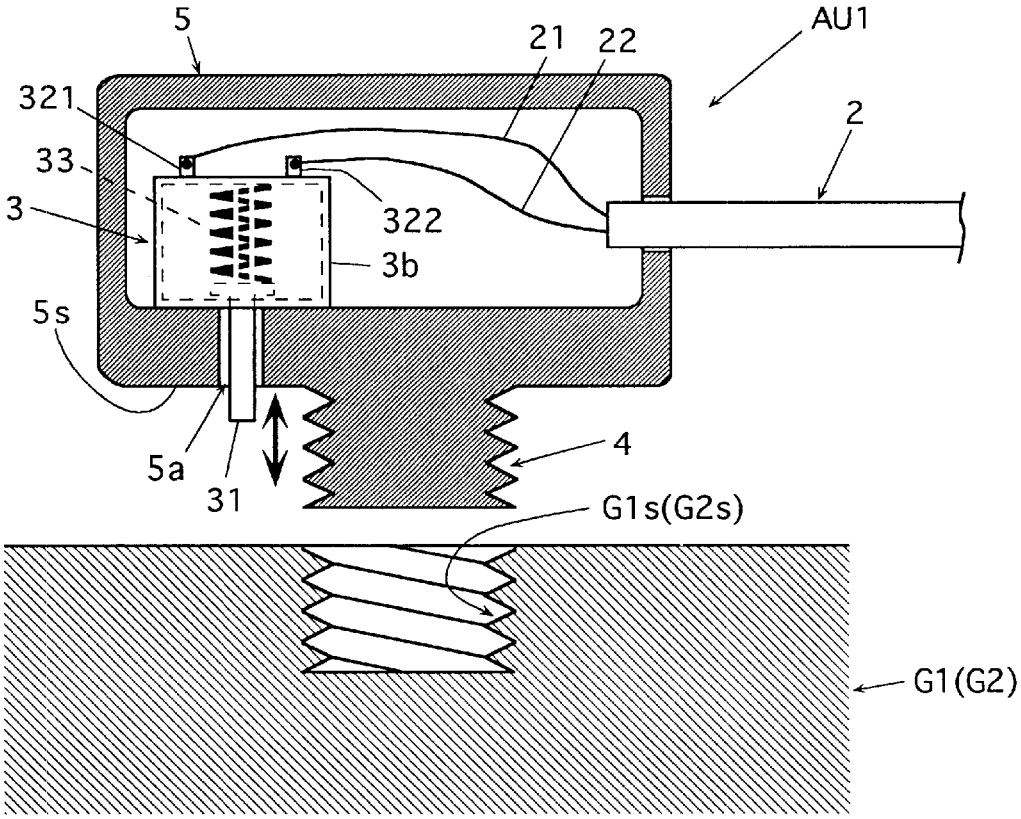
FIG. 2(A) is a schematic section showing an example of the attachment unit before attached to the monitoring target article.
Figure 2B:
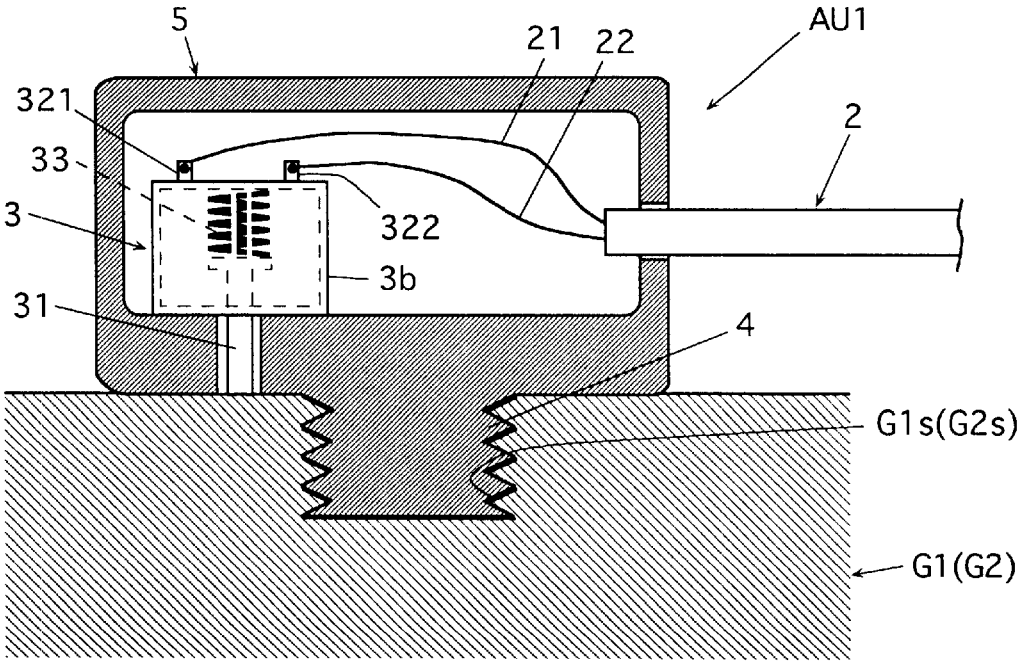
FIG. 2(B) is a schematic section showing the same attachment unit after attached to the monitoring target article.
Figure 3:
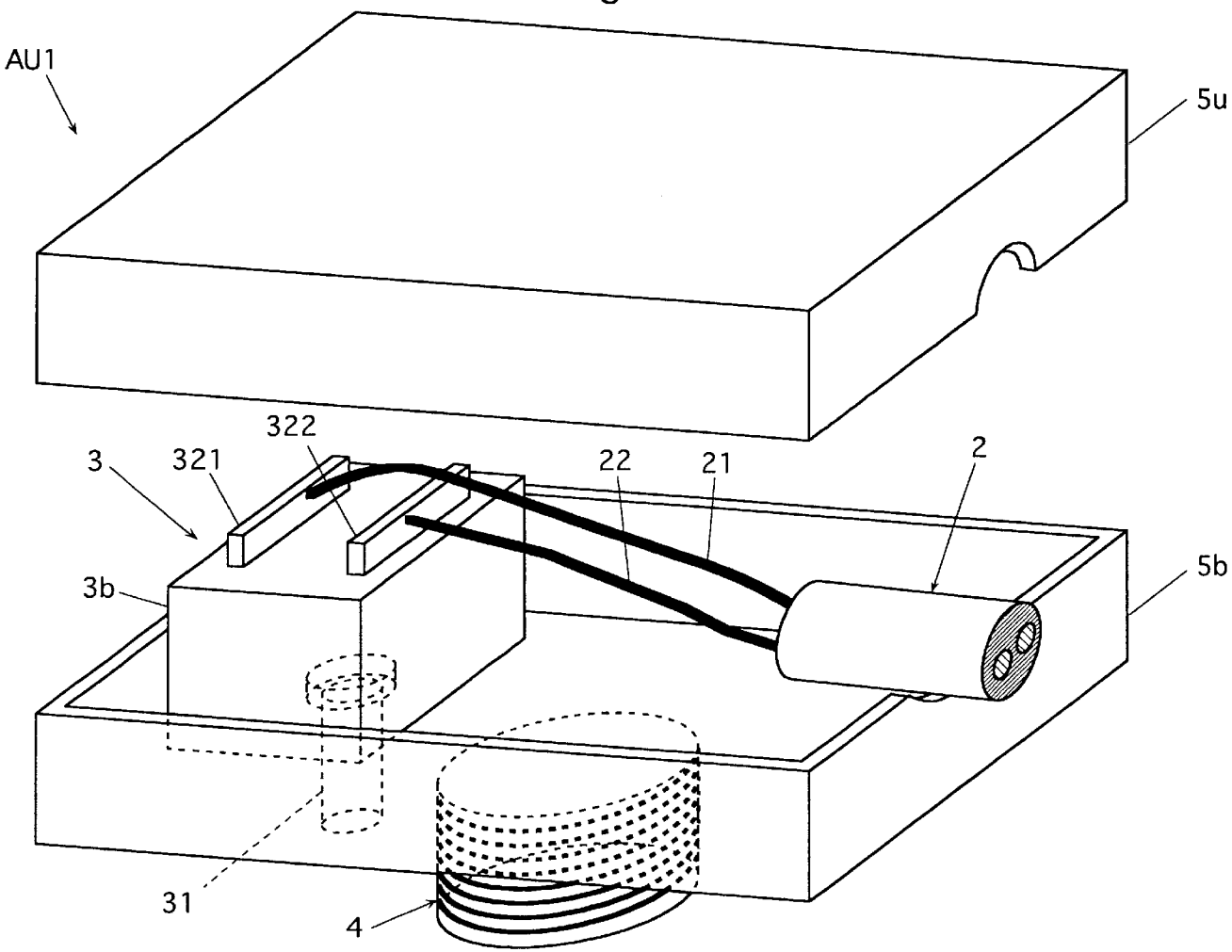
FIG. 3 is a schematic exploded perspective view of the attachment unit of FIG. 2(A).

FIGS. 2(A) and 2(B) are schematic section views of the attachment unit AU1, respectively. FIG. 3 is a schematic perspective exploded view of the attachment unit AU1. Some parts of the attachment unit are not illustrated in FIG. 3.

The attachment units AU1 are to be attached to articles (monitoring target articles) G1 and G2, respectively, to be monitored to avoid being shoplifted.

The monitoring target article G1 and G2 are camera and video camera, respectively, in this example. The camera G1 as the monitoring target article has a female screw G1*s*, which is provided for connecting a tripod (not shown) to the camera G1. Similarly, the video camera G2 as the monitoring target article has a female screw G2*s*, which is provided for connecting a tripod (not shown) to the video camera G2. As described later in detail, the attachment unit AU1 is attached to the monitoring target article by utilizing the female screw of the article.

The alarm device AD issues an alarm based on information detected by the attachment unit AU1. As described later in detail, the alarm device AD issues the alarm, e.g., when the attachment unit AU1 is removed from the article. The detection information of the attachment unit AU1 is sent to the alarm device AD with a cord 2 extending from the attachment unit AU1.

The attachment unit AU1 has a switch 3 for detecting whether the attachment unit AU1 is attached to the monitoring target article or not. The switch 3 is arranged inside a hollow casing 5. The casing 5 is composed of upper and lower casing portions 5*u* and 5*b* as shown in FIG. 3. The upper and lower casing portions 5*u* and 5*b* are fixed together with an adhesive material after arranging the switch 3 to the predetermined position of an inner side of the lower casing portion 5*b*. The switch 3 is fixed to the lower casing portion 5*b* with an adhesive material in this example.

Figure 4:
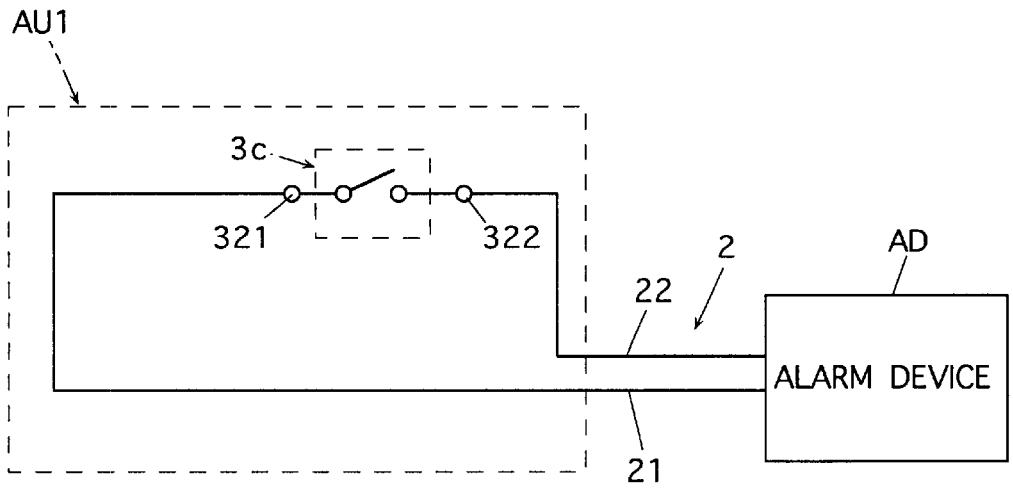
FIG. 4 is a circuit diagram of the contact of the attachment unit.

The switch 3 has a movable piece 31 and a contact 3*c* (see FIG. 4) which is opened or closed in accordance with a position of the movable piece 31 with respect to a switch body 3*b*. The contact 3*c* is opened or closed by already known mechanism (not shown) in accordance with the position of the movable piece 31. In FIG. 2(A) and other figures except FIG. 4, the contact 3*c* of the switch is not illustrated. The contact 3*c* is arranged inside the switch body 3*b*.

The movable piece 31 is capable of moving between inside and outside of the casing 5 through an aperture 5*a*. The aperture 5*a* is provided at a surface (attachment surface) 5*s* to be attached to the monitoring target article. The movable piece 31 is biased to be pushed toward an outside of the attachment surface 5*s*, that is, toward an outside of the casing 5 by a coiled spring 33. The movable piece can project outward from the casing 5 due to the biasing force of the spring 33.

The contact 3*c* of the switch 3 is in a closed state when the movable piece 31 is positioned at an inside of a predetermined standard position. The inside of the standard position is a side nearer to the switch body 3*b*. The contact 3*c* of the switch is in an open state when the movable piece 31 is positioned at the standard position or at an outside of the standard position.

Respective ends of the contact 3*c* of the switch 3 are connected to outer-leads 321 and 322. Open-closed state information of the contact 3*c* is sent to the alarm device AD with lead wires 21 and 22 of the cord 2 connected to the outer-leads 321 and 322, respectively.

The attachment unit AU1 is provided with a screw portion 4 for attaching the attachment unit to the monitoring target article (see FIGS. 2(A), 2(B) and others). The screw portion 4 of the attachment unit AU1 is a male screw that is screw-fittable onto the female screw G1*s* of the monitoring target article G1. The screw G1*s* is provided originally for connecting the tripod to the article (camera) G1 as described above. The screw portion 4 is also screw-fittable onto the female screw G2*s* of the monitoring target article G2. The screw G2*s* is originally provided for connecting the tripod to the article (video camera) as described above.

By screw-fitting the male screw portion 4 onto the female screw G1*s* of the monitoring target article G1 (or onto the female screw G2*s* of the article G2), the attachment unit AU1 is attached to the monitoring target article.

A using manner of the shoplifting monitoring apparatus Al is described below.

The two attachment units AU1 are attached to the monitoring target articles G1 and G2, respectively, each by screw-fitting the male screw portion 4 onto the female screw of the monitoring target article. In this operation, the movable piece 31 of the switch 3 of the attachment unit AU1 is pushed by the article toward the inside of the casing 5, and thereby the contact 3*c* of the switch 3 is set to the closed state. This state is referred to as initial state.

In the initial state, the contact 3*c* of the switch 3 of each of the attachment units AU1 is in the closed state. The alarm device does not issue the alarm in the initial state.

From the initial state, if at least one of the attachment units AU1 is removed from the monitoring target article, the alarm device starts to issue the alarm in the following way. The movable piece 31 of the attachment unit removed from the article projects toward the outside of the casing 5 due to the biasing force by the spring 33. According to this, when the attachment unit AU1 is removed or detached from the monitoring target article, the contact 3*c* of the switch 3 of the attachment unit AU1 removed from the article opens. As described above, when the attachment unit AU1 is removed or detached from the monitoring target article, the open-closed state of the contact 3*c* of the switch 3 changes from the closed state to the open state, which means the attached state of the attachment unit AU1 to the monitoring target article is detected by the switch 3.

The information detected by the switch 3 is sent to the alarm device AD through the lead wires 21 and 22 of the cord 2. Based on the information detected by the switch 3, the alarm device AD issues the alarm. The alarm device AD issues the alarm when the contact 3*c* of at least one of the attachment units AU1 is in the open state. The alarm device AD issues the alarm of a light and sound in this example. The sound and light thus issued out can prevent or suppress the theft or shoplifting of the article. An example of a circuit diagram of the alarm device AD is described later.

In the shoplifting monitoring apparatus A1, the attachment unit AU1 is attached to the monitoring target article by screw-fitting the male screw portion 4 onto the female screw of the monitoring target article. According to this, the attachment unit AU1 can be attached easily to the monitoring target article. The attachment unit AU1 does not make the monitoring target article dirty since the attachment unit is not attached to the article with the double-sided adhesive tape as the conventional manner. Even when the attachment unit AU1 is attached to the monitoring target article for a long time, the attached state or condition of the attachment unit to the article is hard to change. Even after removing the attachment unit from the monitoring target article, the attachment unit AU1 can be attached again to the monitoring target article easily and precisely. Even after attaching and removing the attachment unit AU1 to and from the monitoring target article for a number of times, the attachment unit AU1 can be attached to the monitoring target article precisely. Even when the customer holds the monitoring target article on his or her hands, the attachment unit AU1 is hard to be separated from the article.

Since the attachment unit AU1 is attached to the monitoring target article by screw-fitting as described above, it takes more time for the shoplifter to remove the attachment unit AU1 from the article for shoplifting the article, compared with the case where the attachment unit is attached to the monitoring target article with the double-sided adhesive tape. This can deter the shoplifter from shoplifting the article, and this can make it easier for a staff of the shop to be aware of the shoplifter's action of removing the attachment unit AU1 from the article.

§4.

Figure 5:
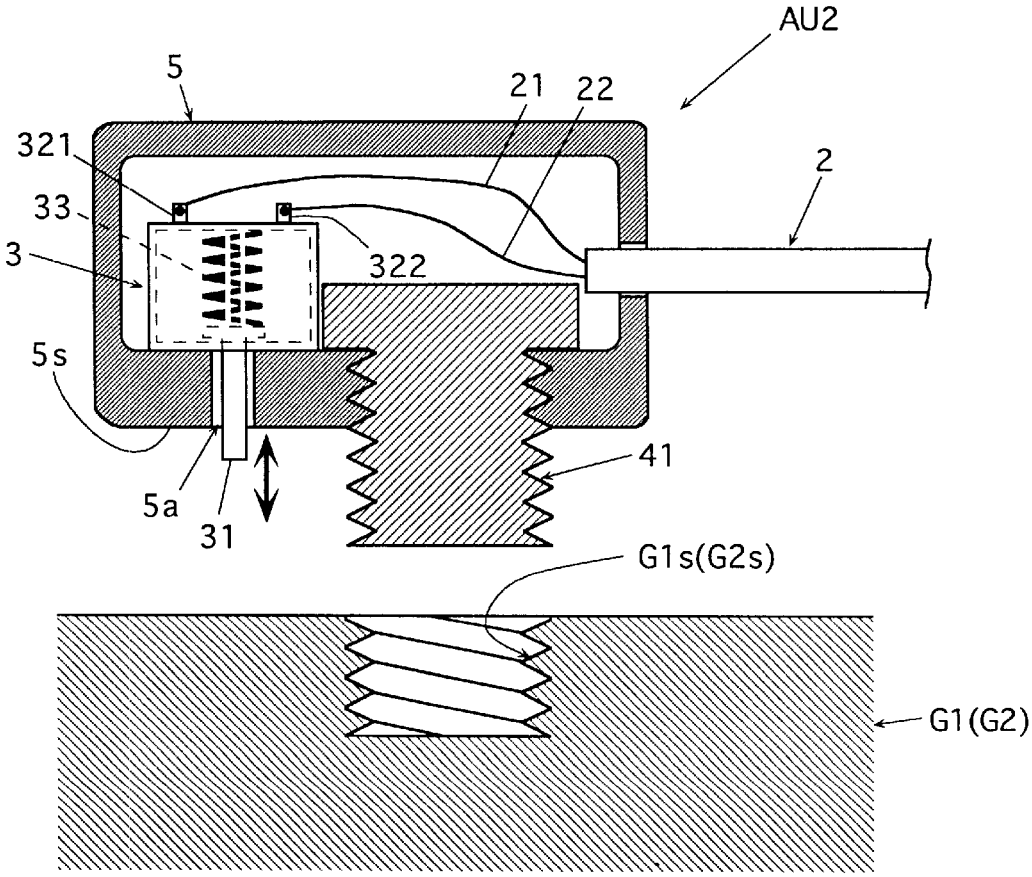
FIG. 5 is a schematic section showing another example of the attachment unit.

In the attachment unit AU1 of FIG. 2(A), the screw portion 4 and casing 5 are of one member. Instead of this, as done in an attachment unit AU2 shown in FIG. 5, the screw portion 41, which is to be screw-fitted onto the female screw G1*s* of the monitoring target article G1 (or female screw G2*s* of the article G2), and the casing 5 may be independent members. In this example, the screw portion 41 is fixed to the casing 5 with an adhesive material so that the screw portion 41 does not move or turn with respect to the casing 5.

Figure 6A:
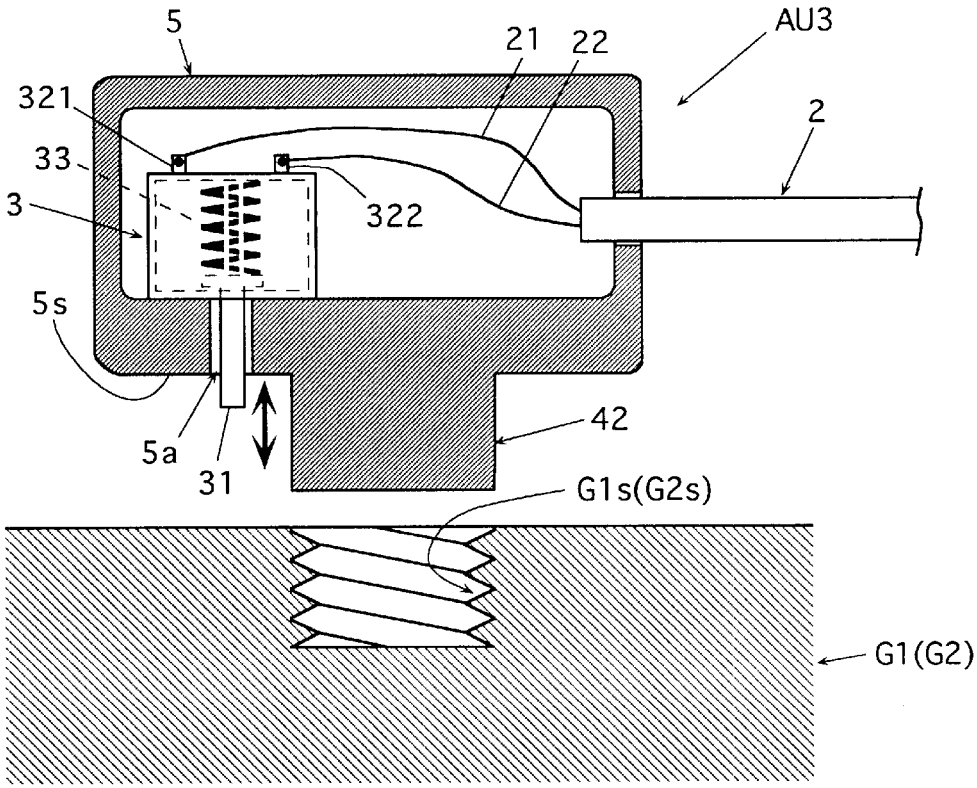
FIG. 6(A) is a schematic section showing still another example of the attachment unit before attached to the monitoring target article.
Figure 6B:
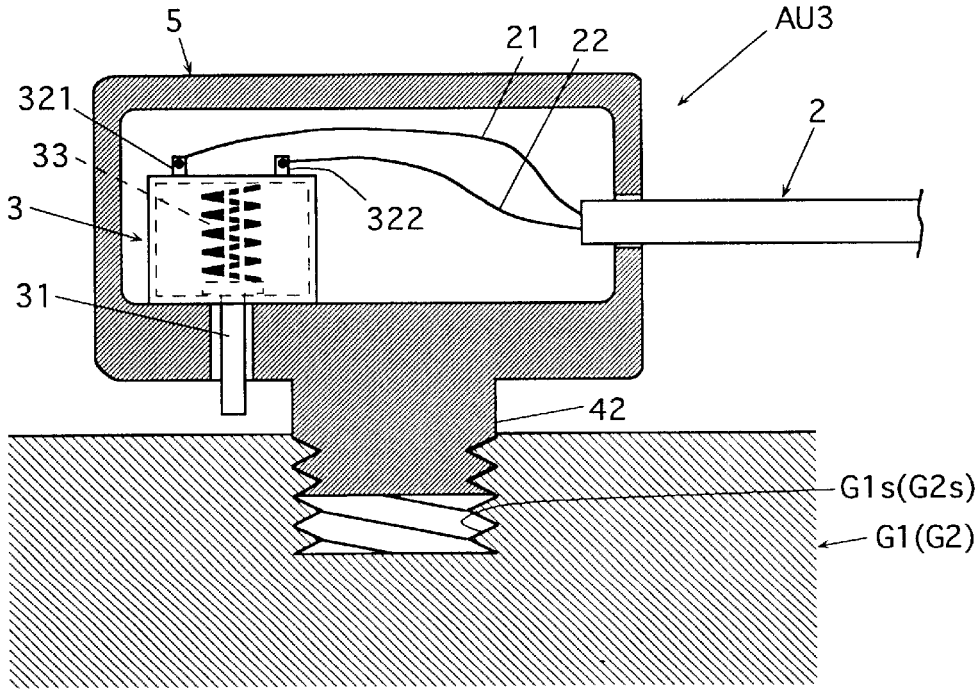
FIG. 6(B) is a schematic section showing the same attachment unit after attached to the monitoring target article.

As done in an attachment unit AU3 shown in FIGS. 6(A) and 6(B), a screw portion 42, to be screw-fitted onto the female screw G1*s* of the monitoring target article G1 (or female screw G2*s* of the article G2), may be screw-fittable onto the female screw of the article while the screw portion 42 is screw-threaded by the female screw of the article. According to this, the screw portion 42 can be screw-fitted onto the screw of the article whatever pitch and others the screw of the article has, while the screw portion 42 is screw-threaded in accordance with the pitch and others of the screw of the article as shown in FIG. 6(B), so that the attachment unit AU3 is attached to the article.

§5.

Figure 7A:
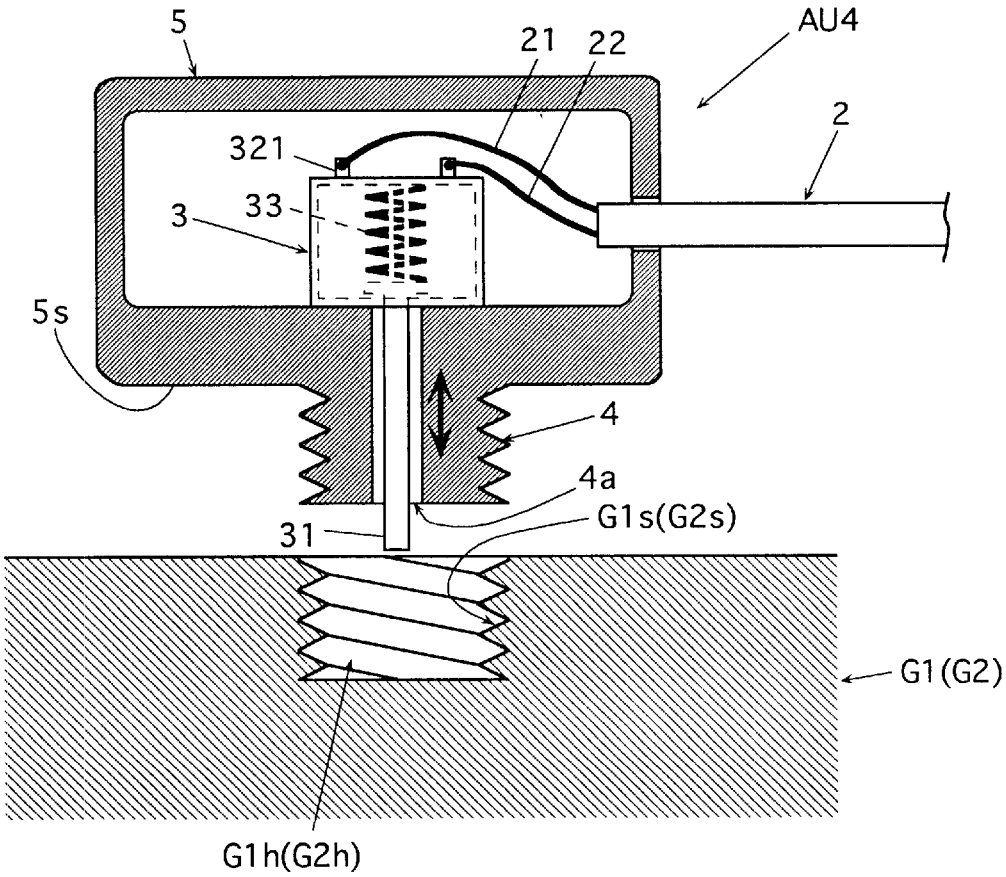
FIG. 7(A) is a schematic section showing still another example of the attachment unit before attached to the monitoring target article.
Figure 7B:
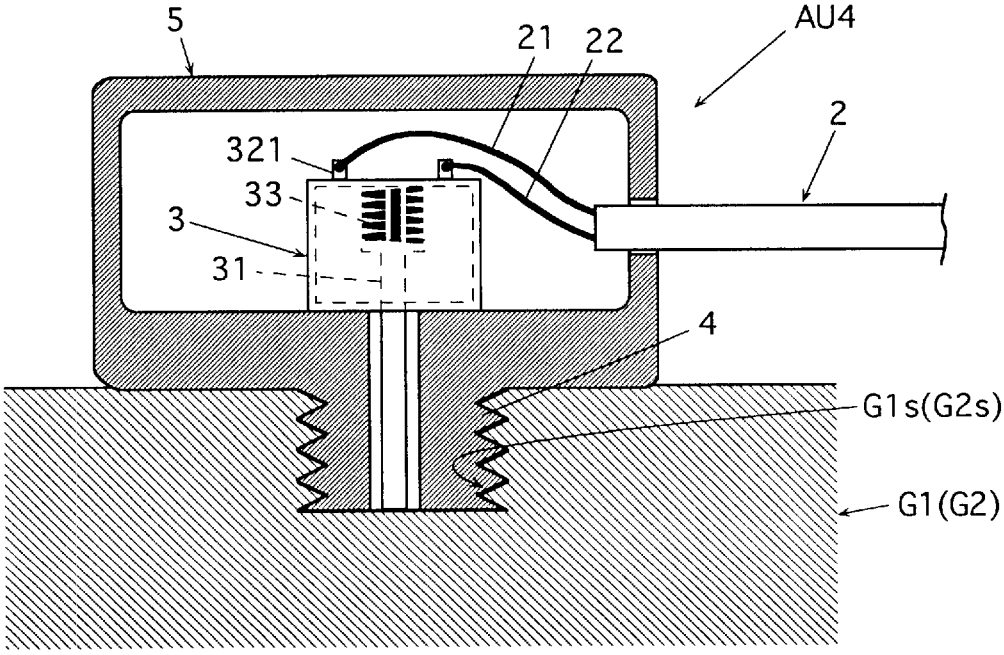
FIG. 7(B) is a schematic section showing the same attachment unit after attached to the monitoring target article.

Further another example of the attachment unit is shown in FIGS. 7(A) and 7(B).

In an attachment unit AU4 shown in FIGS. 7(A) and 7(B), an aperture 4*a* is provided at the male screw portion 4 along the longitudinal direction (axis direction) of the screw portion 4. A part of the movable piece 31 of the switch 3 is arranged inside the aperture 4*a*, and the movable piece is configured to move inside the aperture 4*a*.

The attachment unit AU4 of FIGS. 7(A) and 7(B) has following advantages, compared with the foregoing attachment unit AU1 of FIGS. 2(A) and 2(B).

In each of the attachment units AU1 and AU4, the switch 3 is provided for detecting whether the attachment unit is attached to the monitoring target article or not, and the alarm device AD issues the alarm when the switch 3 detects that the attachment unit is removed from the article.

However, if the following malicious act is conducted, the removal of the attachment unit from the monitoring target article cannot be detected by the switch 3.

Figure 8:
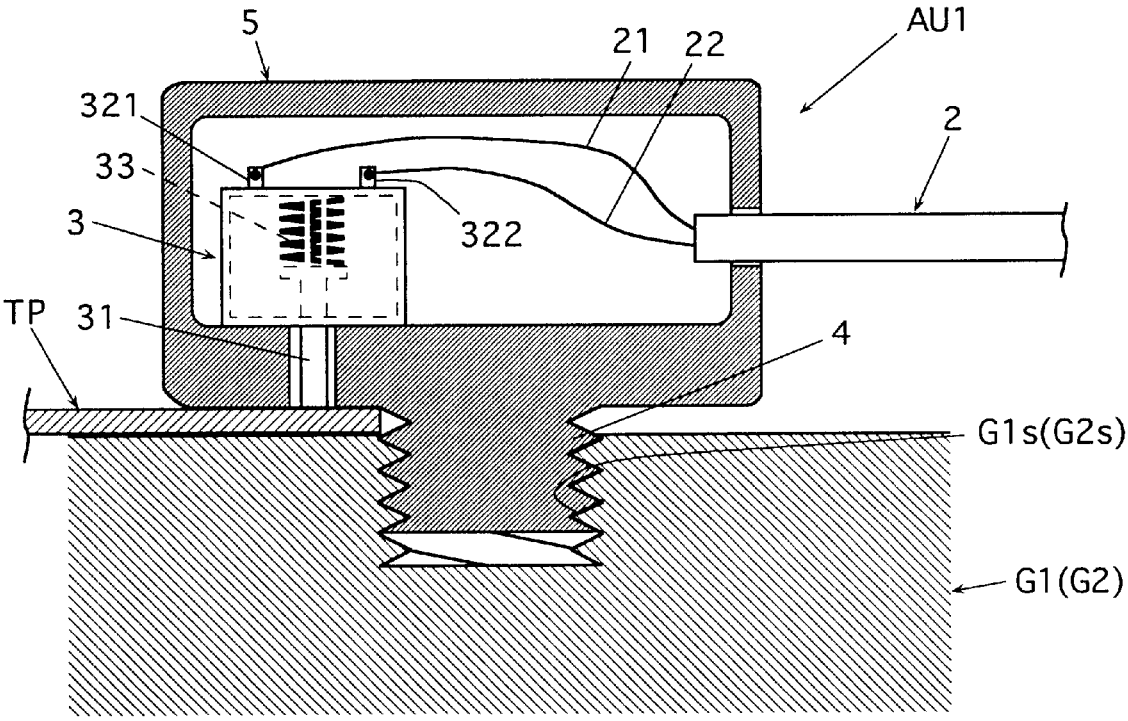
FIG. 8 shows such a situation that a thin plate is inserted into between the monitoring target article and the attachment unit of FIG. 2(A) attached to the article.

If a thin plate TP were inserted into between the attachment unit AU1 and the monitoring target article G1 as shown in FIG. 8, and the movable piece 31 of the switch 3 were held by the thin plate TP not to project outward from the casing 5 even when the attachment unit is removed from the article, in other words, if the movable piece 31 were held such that the contact 3*c* of the switch 3 does not open even when the attachment unit is removed from the article, the switch 3 cannot detect, after the movable piece is held as described above, the removal of the attachment unit AU1 from the article even when the attachment unit is removed from the article.

In contrast to the above, when the attachment unit AU4 of FIGS. 7(A) and 7(B) is attached to the monitoring target article, the end portion of the movable piece 31 is located inside the screw hole G1*h* (or G2*h*) of the article, and the screw portion 4 surrounds the movable piece 31. According to these, it can be suppressed that the movable piece 31 is held by the thin plate such that the contact of switch does not become open, in other words, such that the alarm does not arise. The switch 3 of the attachment unit AU4 can therefore detect more precisely whether the attachment unit AU4 is attached to the monitoring target article or not.

§6.

Figure 9A:
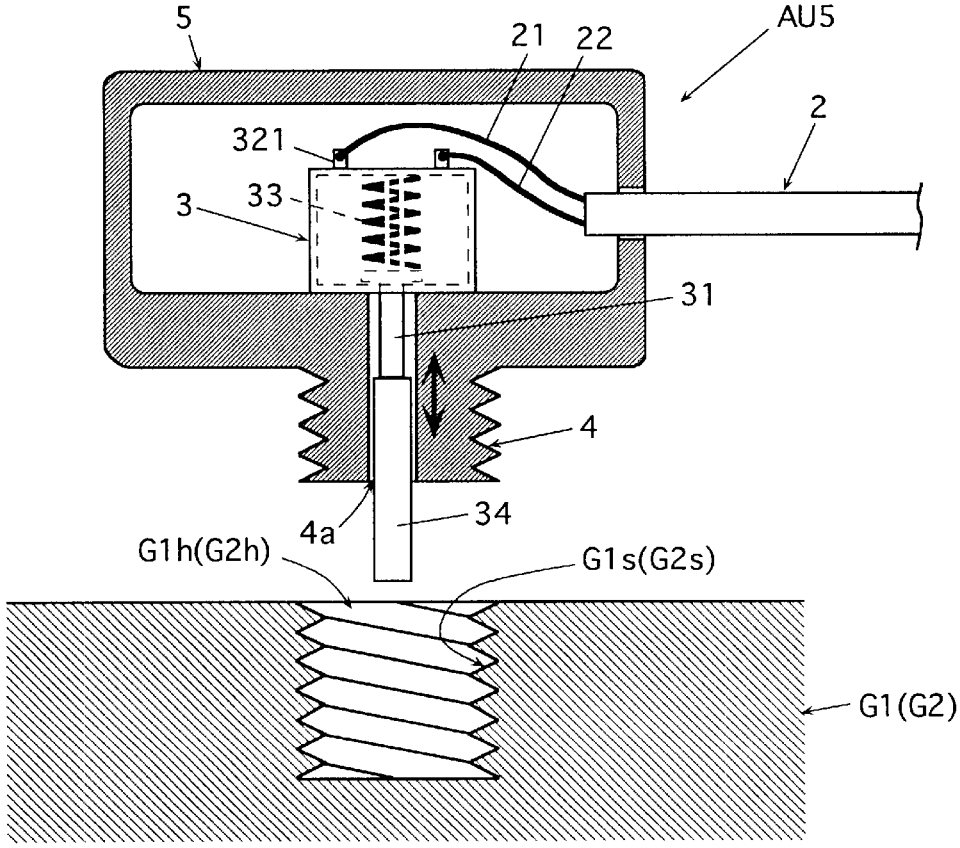
FIG. 9(A) is a schematic section showing still another example of the attachment unit before attached to the monitoring target article.
Figure 9B:
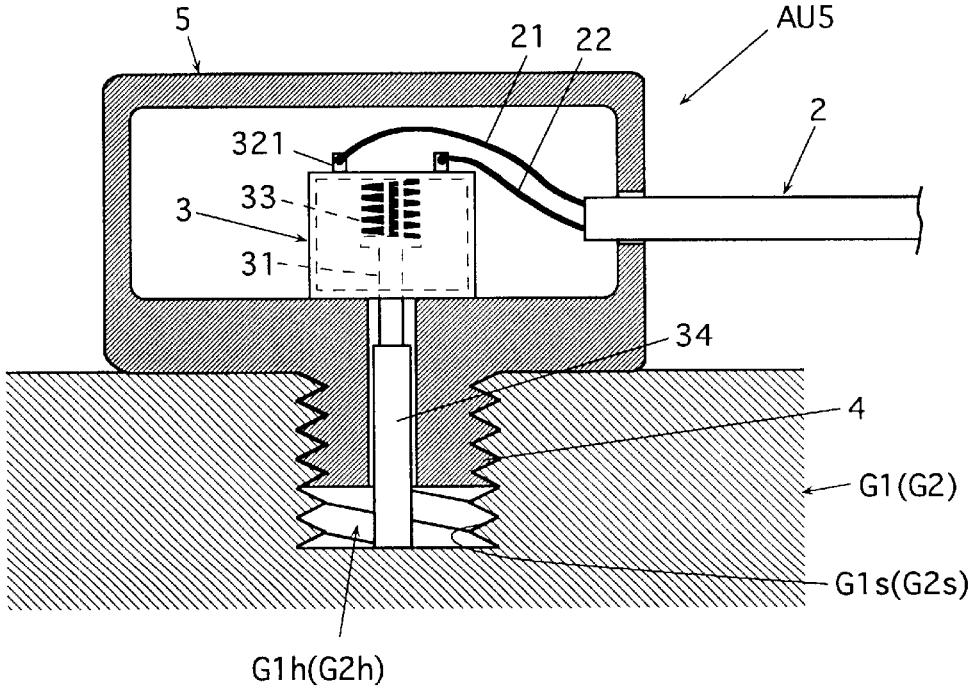
FIG. 9(B) is a schematic section showing the same attachment unit after attached to the monitoring target article.

Further another example of the attachment unit is shown in FIGS. 9(A) and 9(B).

In the attachment unit AU5 of FIGS. 9(A) and 9(B), an extension rod 34 is arranged at an end portion of the movable piece 31 of the switch 3. The extension rod 34 and movable piece 31 are fixed to each other with adhesive material in this example. The movable piece 31 and extension rod 34 therefore move together. It can be considered that the extension rod 34 is a part of the movable piece of the switch since the extension rod 34 moves together with the movable piece.

Length of the movable piece of a commercially available switch is not so long for preventing breakage of the movable piece or for other purposes. The movable piece 31, therefore in some cases, cannot reach a bottom surface of the screw hole G1*h* (or G2*h*) of the monitoring target article G1 (or G2) when the attachment unit is attached to the article, which depends on the depth of the screw hole G1*h* (or G2*h*). If so, even after the attachment unit is attached to the monitoring target article, the movable piece 31 is not pushed toward the inside of the casing 5, and thereby the contact of the switch 3 is not closed. As a result, the switch cannot detect whether the attachment unit is attached to the article.

In the case described above or other cases, by providing an extension member such as the extension rod 34 at the end portion of the movable piece for making the length of the movable piece 31 longer, the switch can cope with the article having the deep screw hole.

Instead of fixing the extension rod 34 and movable piece 31 with the adhesive material, the extension rod and movable piece may be connected to each other in a detachable fashion, e.g. by screw-fitting or fitting them to each other. According to this, by preparing a plurality of extension rods of different lengths, the switch can cope with the articles having screw holes of different depths.

§7.

Figure 10A:
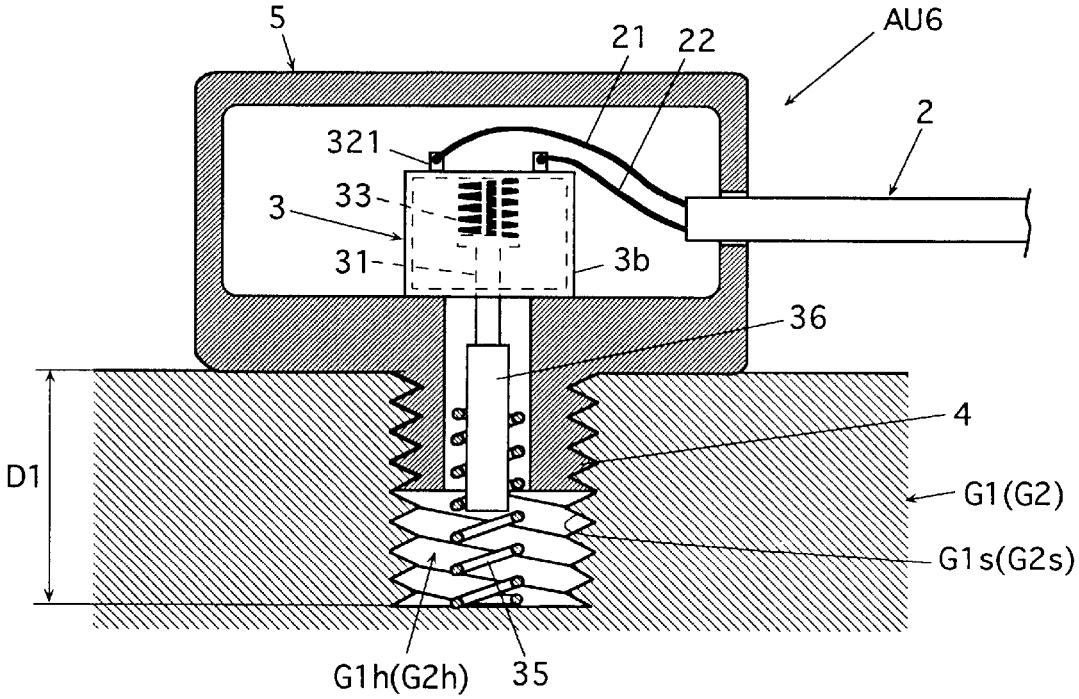
FIGS. 10(A) and 10(B) are schematic sections showing still another example of the attachment unit, respectively.
Figure 10B:
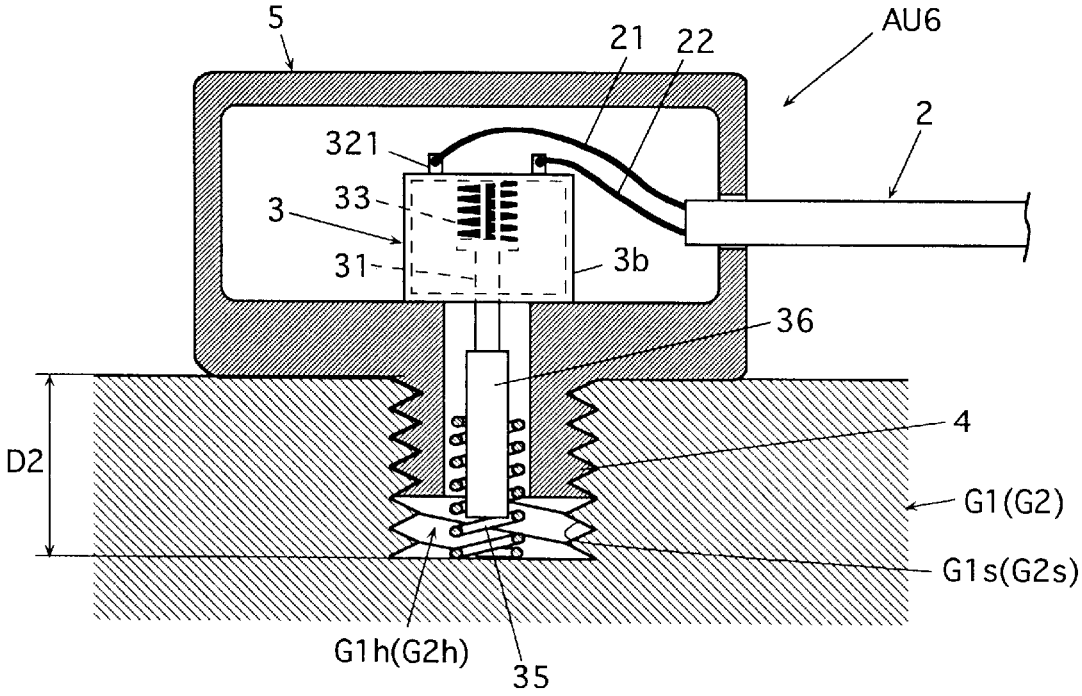

Further another example of the attachment unit is shown in FIGS. 10(A) and 10(B).

In an attachment unit AU6 of FIGS. 10(A) and 10(B), a coiled spring 35 is connected to the movable piece 31 of the switch 3 so that the spring 35 moves together with the movable piece 31. The coiled spring 35 is fitted around a rod 36 fixed to the movable piece 31 with an adhesive material, and the spring 35 is fixed to the rod 36 with an adhesive material. According to these, the movable piece 31, rod 36 and spring 35 can move together. The spring 35 is extended beyond an end of the rod 36.

By provision of the spring 35 described above, the movable piece 31 can be pushed via the spring 35 toward the inside of the casing while the spring 35 expands or contracts in accordance with the depth of screw hole of the article, and thereby the contact of the switch is set to the closed state, in both of the cases where the attachment unit AU6 is attached to the monitoring target article having the screw hole of D1 in depth shown in FIG. 10(A), and where the attachment unit AU6 is attached to the monitoring target article having the screw hole of D2 (D2<D1) in depth shown in FIG. 10(B). That is, the difference of depths of the screw holes can be absorbed by the expansion and contraction of the spring 35.

In this example, spring modulus of the spring 35 is set to be larger than that of the spring 33 biasing to push the movable piece 31 toward the outside of the attachment surface, the spring 33 therefore firstly contracts to a larger extent than the spring 35. In other words, the spring 35 starts to contract to a large extent after the movable piece 31 is pushed toward the switch body 3*b*, and thereby after the switch contact becomes closed.

From the investigation by the inventor, cameras (including digital cameras) and video cameras of eleven manufacturers have screw holes, each of which is originally provided for connecting the tripod, of 5.6 mm in minimum depth and of 7.0 mm in maximum depth. If the difference of depths of the screw holes are to the above extent, the spring 35 can absorb the difference.

The spring 35 is fixed to the movable piece 31 of the switch 3 via the rod 36 in this example as described above, instead of this, the spring 35 may be fixed directly to the movable piece 31. Anyway, it can be considered that the spring 35 is a part of the movable piece of the switch since the spring 35 moves together with the movable piece 31.

§8.

Figure 11A:
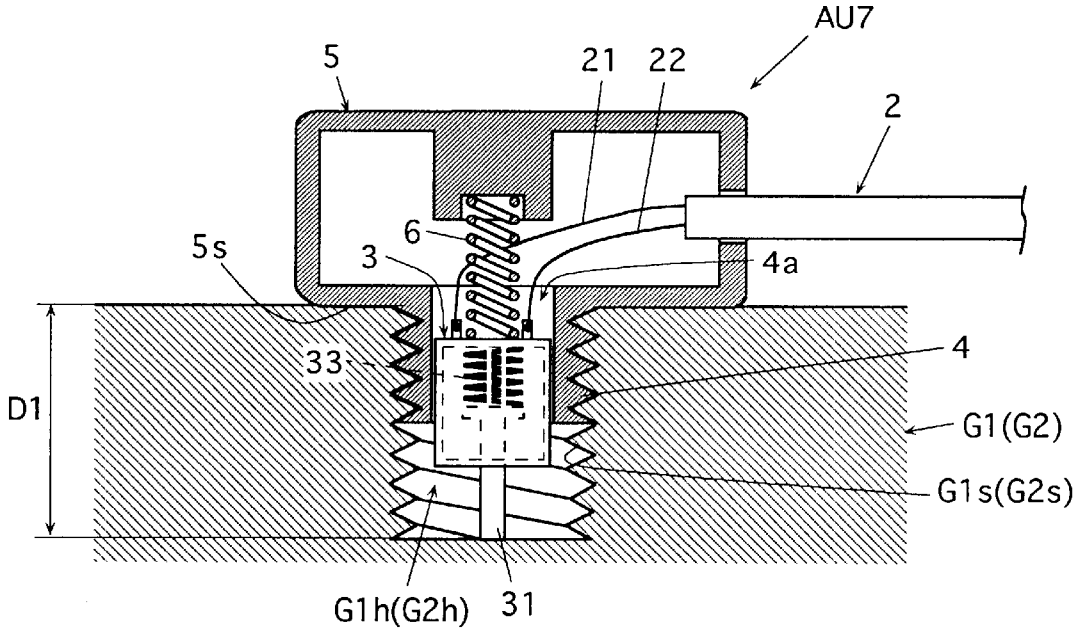
FIGS. 11(A) and 11(B) are schematic sections showing still another example of the attachment unit, respectively.
Figure 11B:
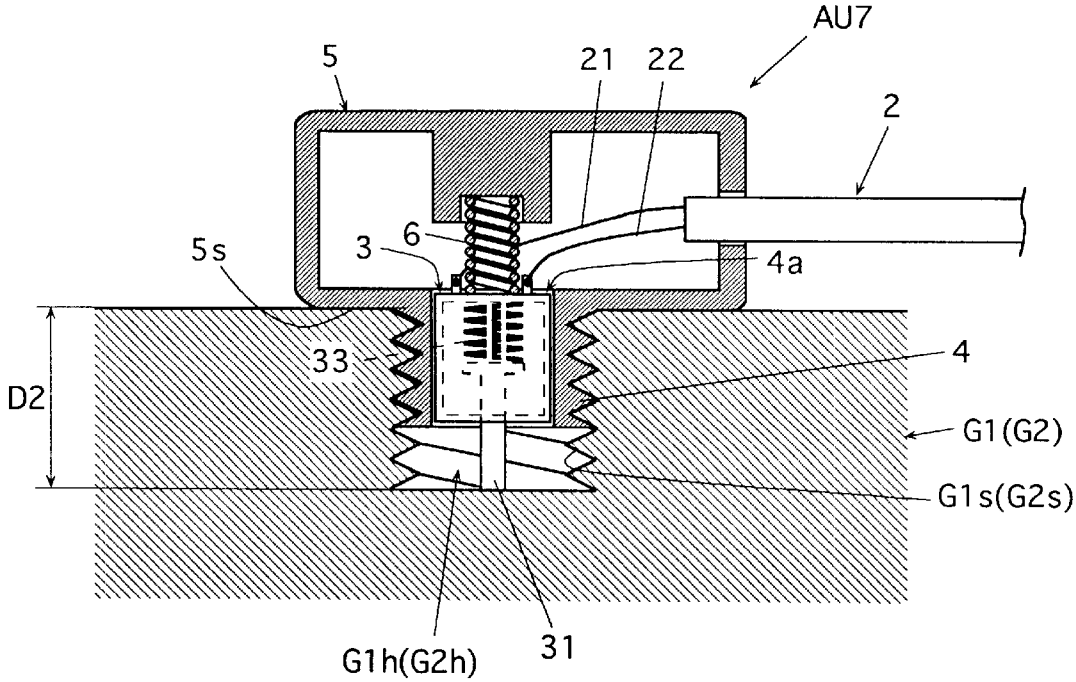

Further another example of the attachment unit is shown in FIGS. 11(A) and 11(B).

In the attachment unit AU7 of FIGS. 11(A) and 11(B), the switch 3 is arranged inside the aperture 4*a* of the male screw portion 4 of the attachment unit. This aperture 4*a* has a section form corresponding to the section form of the switch 3. As guided by the inner surface of the aperture 4*a*, the switch 3 itself can move inside the aperture 4*a* in the direction from the inside to outside of the attachment surface 5*s* and the reverse direction thereof. The switch 3 is pushed by a coiled spring 6 toward the outside of the attachment surface 5*s*. In this example, the switch 3 and spring 6 are fixed to each other with an adhesive material, and the spring 6 and an inner wall of the casing 5 are also fixed to each other with an adhesive material.

By provision of the spring 6 described above, similarly to the attachment unit AU6 of the FIGS. 10(A) and 10(B), the movable piece 31 of the switch 3 can be pushed toward the inside of the casing while the spring 6 expands or contracts in accordance with the depth of screw hole of the article, and thereby the contact of the switch 3 is set to the closed state, in both of the cases where the attachment unit AU7 is attached to the monitoring target article having the screw hole of D1 in depth shown in FIG. 11(A), and where the attachment unit AU7 is attached to the monitoring target article having the screw hole of D2 (D2<D1) in depth shown in FIG. 11 (B). That is, the difference of depths of the screw holes can be absorbed by the expansion and contraction of the spring 6.

In this example, spring modulus of the spring 6 is set to be larger than that of the spring 33 biasing to push the movable piece 31 toward the outside of the attachment surface, the spring 33 therefore firstly contracts to a larger extent than the spring 6 when the attachment unit AU7 is attached to the article, and thereby the movable piece 31 is pushed toward the inside of the attachment surface.

§9.

Figure 12:
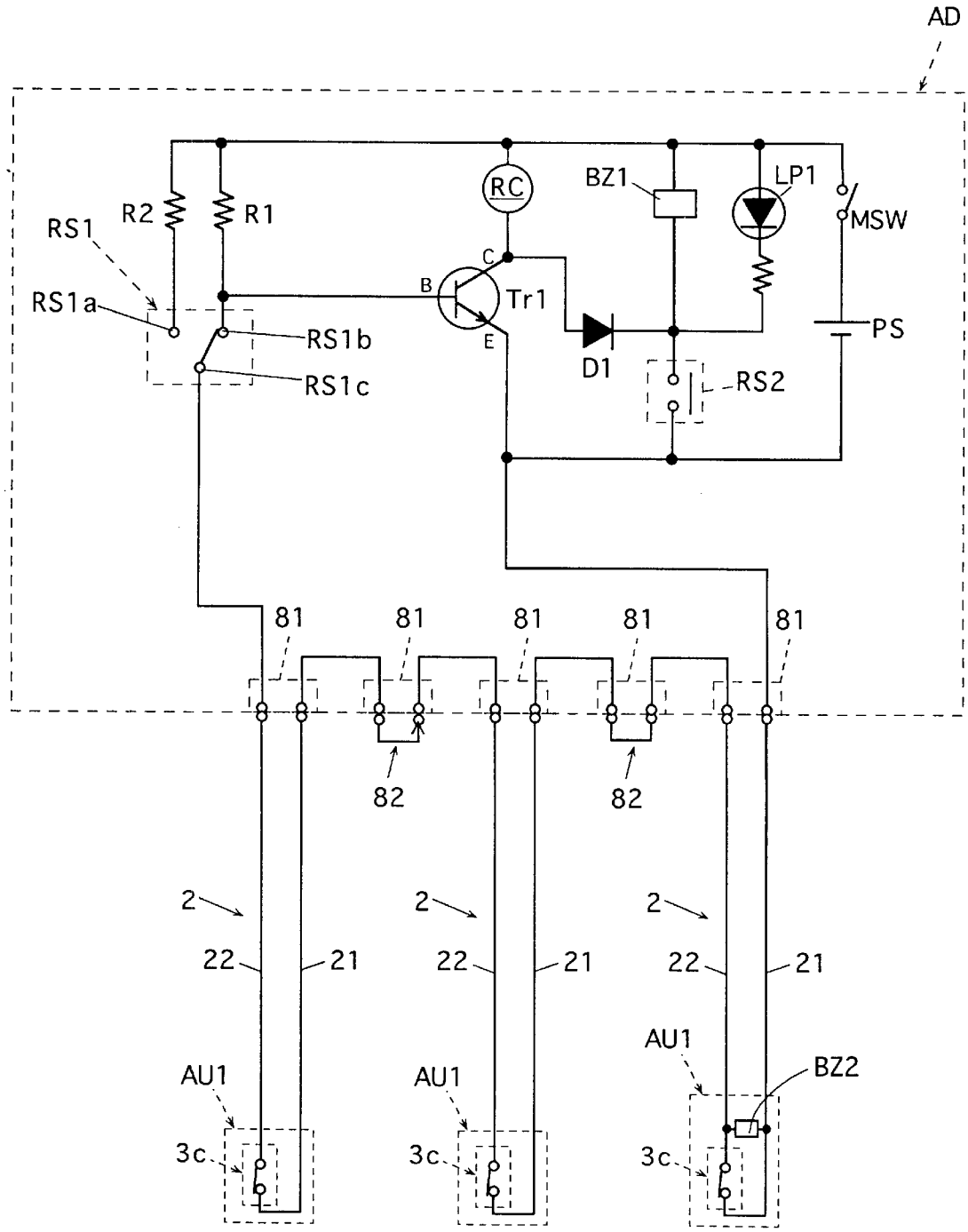
FIG. 12 shows a circuit diagram of an example of the alarm device.

FIG. 12 shows an example of a circuit diagram of the alarm device AD.

The alarm device AD of FIG. 12 has a buzzer BZ1 and a light-emitting diode lamp LP1 both serving as the alarming elements as well as a drive circuit for driving the alarming elements based on the information sent from the attachment unit.

In FIG. 12, the attachment unit AU1 is employed as the attachment unit.

The alarm device AD has five female connectors 81 each for connection with the cord 2 extending from the attachment unit AU1 in this example. A male connector (not shown) which can fit to the female connector 81 is provided at an end, to be connected to the alarm device AD, of the cord 2, and therefore the cord 2 can be easily connected to the alarm device AD. A short-circuit cord 82 is connected to the connector 81 to which the cord 2 is not connected.

In the alarm device AD, an energized state of a relay coil RC and an on-off state of a transistor Tr1 are controlled based on the contact state of each of the attachment units AU1. According to this, the open-closed states of relay contacts RS1 and RS2 are controlled so that application of a voltage to the alarming element from a power source PS is controlled. The relay contacts RS1 and RS2 are opened or closed according to the energized state of the relay coil RC. The relay contact RS1 has three terminals RS1*a,* RS1*b* and RS1*c*. The terminal RS1*c* is a common terminal. A normally open contact is formed by the terminals RS1*a* and RS1*c,* and a normally closed contact is formed by the terminals RS1*b* and RS1*c*. The relay contact RS2 is a normally open contact.

For putting the alarm device AD to use, each of the attachment units AU1 is attached to the article so that the switch contact 3*c* is closed, and thereafter a main switch MSW is closed. In this initial state, the transistor Tr1 is off, the relay coil RC is not energized and the relay contact RS2 is open. Consequently a voltage is not applied from the power source PS to the buzzer BZ1 and lamp LP1 serving as the alarming elements, so that the alarm is not issued.

When the contact 3*c* in at least one of the attachment units AU1 in the initial state becomes open, then the transistor Tr1 is on, the relay coil RC is energized, the relay contact RS2 is closed, and finally a voltage is applied to the buzzer BZ1 and lamp LP1. Thereby the buzzer BZ1 and the lamp LP1 start to issue the alarms. When the relay coil RC is once energized, the buzzer BZ1 and lamp LP1 continue to issue the alarm even if the transistor Tr1 becomes off. This is because the energized state of the relay coil RC is maintained by its contact RS2 connected in series to the relay coil and the power source PS. The alarm device continues to issue the alarms until the main switch MSW is shut off.

Alarms are also raised, for example, when the lead wires 21 and/or 22 of the cable 2 in the initial state are cut off, or when the cable 2 in the initial state is pulled off from the connector 81 of the alarm device AD.

The alarming element (buzzer BZ2 in this example) may be parallel connected to the contact 3*c* as is done in the rightmost attachment unit AU1 in FIG. 12. According to this, a voltage is not applied to the buzzer BZ2 when the contact 3*c* is closed, and therefore the alarm is not issued from the buzzer BZ2. When the contact 3*c* is open, a voltage is applied to the buzzer BZ2 from the power source PS via a resistance R2, and thereby the buzzer BZ2 issues the alarm.

If the alarming element is arranged at the attachment unit as described above, the alarm is issued at the site of shoplifting. More specifically, the alarm is raised at the hand of the shoplifter who has detached the attachment unit from the article. The theft or shoplifting of the article would be more likely to be prevented in the case of giving the alarm at the hand of the shoplifter, compared with the case where the alarm is raised in a position little apart from the shoplifter. Further, the alarm can let the shoplifter become aware that the action of shoplifting is caught.

Of course, the alarm may be given at a position (e.g. at a location remote from an area of displayed articles) where the shoplifter cannot be aware of the alarm.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A shoplifting monitoring apparatus comprising:

an attachment unit having an attachment surface to be attached to an article, the attachment unit including a detection element for detecting whether the attachment unit is attached to the article or not; and an alarm device issuing an alarm based on information indicating that the attachment unit is not attached to the article, the information being detected by the detection element; wherein the attachment unit is provided at the attachment surface with a first portion screw-fittable onto a screw of the article;

the attachment unit can be attached to the article by screw-fitting the first portion of the attachment unit onto the screw of the article;

the detection element is a switch including a movable piece and a contact, the contact is put in an open state or a closed state in accordance with a position of the movable piece;

the movable piece is biased toward an outside of the attachment surface;

the contact is put in the closed state when the movable piece is pushed toward an inside of the attachment surface so that the movable piece is located at an inside of a standard position;

the contact is put in the open state when the movable piece is located at the standard position or at an outside of the standard position;

the attachment unit can be attached to the article such that the movable piece is pushed toward the inside of the attachment surface, and the movable piece is located at the inside of the standard position, and thereby the contact is put in the closed state;

the alarm device issues the alarm at least when the contact of the switch is in the open state;

the first portion of the attachment unit is a male screw;

the male screw is provided with an aperture extending along a longitudinal direction of the male screw; and at least a part of the movable piece of the switch is arranged inside the aperture of the male screw.

2. The shoplifting monitoring apparatus according to claim 1, wherein the article to which the attachment unit is to be attached is a camera or a video camera.

3. The shoplifting monitoring apparatus according to claim 2, wherein the first portion of the attachment unit can be screw-fitted onto the screw of the article, the screw of the article being provided at the article for connecting a tripod to the article.

4. The shoplifting monitoring apparatus according to claim 1, wherein the attachment unit further includes an extension rod that moves together with the movable piece of the switch; and the movable piece is pushed via the extension rod toward the inside of the attachment surface when the attachment unit is attached to the article.

5. The shoplifting monitoring apparatus according claim 1, wherein the attachment unit further includes an elastic member that moves together with the movable piece of the switch; and the movable piece is pushed via the elastic member toward the inside of the attachment surface when the attachment unit is attached to the article.

6. A shoplifting monitoring apparatus comprising:

an attachment unit having an attachment surface to be attached to an article, the attachment unit including a detection element for detecting whether the attachment unit is attached to the article or not; and an alarm device issuing an alarm based on information indicating that the attachment unit is not attached to the article, the information being detected by the detection element; wherein the attachment unit is provided at the attachment surface with a first portion screw-fit table onto a screw of the article;

the attachment unit can be attached to the article by screw-fitting the first portion of the attachment unit onto the screw of the article;

the detection element is a switch including a movable piece and a contact;

the contact is put in an in an open state or a closed state in accordance with a position of the movable piece;

the movable piece is biased toward an outside of the attachment surface;

the contact is put in the closed state when the movable piece is pushed toward an inside of the attachment surface so that the movable piece is located at an inside of a standard position;

the contact is put in the open state when the movable piece is located at the standard position or at an outside of the standard position;

the attachment unit can be attached to the article such that the movable piece is pushed toward the inside of the attachment surface, and the movable piece is located at the inside of the standard position, and thereby the contact is put in the closed state;

the alarm device issues the alarm at least when the contact of the switch is in the open state;

the first portion of the attachment unit is a male screw;

the male screw is provided with an aperture extending along a longitudinal directing of the male screw;

the switch is configured to move inside the aperture of the male screw; and the switch is biased toward the outside of the attachment surface.

7. The shoplifting monitoring apparatus according to claim 6 wherein the article to which the attachment unit is to be attached is a camera or a video camera.

8. The shoplifting monitoring apparatus according to claim 7, wherein the first portion of the attachment unit can be screw-fitted onto the screw of the article, the screw of the article being provided at the article for connecting a tripod to the article.

9. A shoplifting monitoring apparatus comprising:

an attachment unit having an attachment surface to be attached to an article, the attachment unit including a detection element for detecting whether the attachment unit is attached to the article or not; and an alarm device issuing an alarm based on information indicating that the attachment unit is not attached to the article, the information being detected by the detection element; wherein the attachment unit is provided at the attachment surface with a unthreaded projection portion projecting from the attachment surface and screw-fittable into a female screw of the article;

the attachment unit is attached to the article by screw-fitting the unthreaded projection portion of the attachment unit into the female screw of the article, and the unthreaded projection portion of the attachment unit is screw-fitted into the female screw of the article while the unthreaded projection portion is screw-threaded by the female screw of the article thereby converting the unthreaded projection portion to a threaded projection portion.

10. The shoplifting monitoring apparatus according to claim 9 wherein the article to which the attachment unit is to be attached is a camera or a video camera.

11. The shoplifting monitoring apparatus according to claim 10, wherein the unthreaded projection portion of the attachment unit is screw-fitted into the female screw of the article, the female screw of the article being provided at the article for connecting a tripod to the article.

12. An attachment unit utilized in a shoplifting monitoring apparatus and having an attachment surface to be attached to an article, the attachment unit comprising:

a detection element for detecting whether the attachment unit is attached to the article or not; and a first portion screw-fittable onto a screw of the article and arranged at the attachment surface; wherein the attachment unit can be attached to the article by screw-fitting the first portion of the attachment unit onto the screw of the article;

the detection element is a switch including a movable piece and a contact;

the contact is put in an open state or a closed state in accordance with a position of the movable piece;

the movable piece is biased toward an outside of the attachment surface;

the contact is put in the closed state when the movable piece is pushed toward an inside of the attachment surface so that the movable piece is located at an inside of a standard position;

the contact is put on the open state when the movable piece is located at the standard position or at an outside of the standard position;

the attachment unit can be attached to the article such that the movable piece is pushed toward the inside of the attachment surface, and the movable piece is located at the inside of the standard position, and thereby the contact is put in the closed state;

the first portion of the attachment unit is a male screw;

the male screw is provided with an aperture extending along a longitudinal direction of the male screw; and at least a part of the movable piece of the switch is arranged inside the aperture of the male screw.

13. The attachment unit according to claim 12, wherein the article to which the attachment unit is to be attached is a camera or a video camera.

14. The attachment unit according to claim 13, wherein the first portion of the attachment unit can be screw-fitted onto the screw of the article, the screw of the article being provided at the article for connecting a tripod to the article.

15. The attachment unit according to claim 12, wherein the attachment unit further includes an extension rod that moves together with the movable piece of the switch; and the movable piece is pushed via the extension rod toward the inside of the attachment surface when the attachment unit is attached to the article.

16. The attachment unit according to claim 12, wherein the attachment unit further includes an elastic member that moves together with the movable piece of the switch; and the movable piece is pushed via the elastic member toward the inside of the attachment surface when the attachment unit is attached to the article.

17. An attachment unit utilized in a shoplifting monitoring apparatus and having an attachment surface to be attached to an article, the attachment unit comprising:

a detection element for detecting whether the attachment unit is attached to the article or not; and a first portion screw-fittable onto a screw of the article and arranged at the attachment surface; wherein the attachment unit can be attached to the article by screw-fitting the first portion of the attachment unit onto the screw of the article;

the detection element is a switch including a movable piece and a contact;

the contact is put in an open state or a closed state in accordance with a position of the movable piece;

the movable piece is biased toward an outside of the attachment surface;

the contact is put in the closed state when the movable piece is pushed toward an inside of the attachment surface so that the movable piece is located at an inside of a standard position;

the contact is put in the open state when the movable piece is located at the standard position or at an outside of the standard position;

the attachment unit can be attached to the article such that the movable piece is pushed toward the inside of the attachment surface, and the movable piece is located at the inside of the standard position, and thereby the contact is put in the closed state;

the first portion of the attachment unit is a male screw;

the male screw is provided with an aperture extending along a longitudinal direction of the male screw;

the switch is configured to move inside the aperture of the male screw; and the switch is biased toward the outside of the attachment surface.

18. The attachment unit according to claim 17, wherein the article to which the attachment unit is to be attached is a camera or a video camera.

19. The attachment unit according to claim 23, wherein the unthreaded projection portion of the attachment unit is screw-fitted into the female screw of the article, the female screw of the article being provided at the article for connecting a tripod to the article.

20. An attachment unit utilized in a shoplifting monitoring apparatus and having an attachment surface to be attached to an article, the attachment unit comprising:

a detection element for detecting whether the attachment unit is attached to the article or not; and a unthreaded projection portion screw-fittable onto a female screw of the article and arranged at and projecting from the attachment surface; wherein the attachment unit is attached to the article by screw-fitting the unthreaded projection portion of the attachment unit into the female screw of the article; and the unthreaded projection portion of the attachment unit is screw-fitted into the female screw of the article while the unthreaded projection portion is screw-threaded by the female screw of the article thereby converting the unthreaded projection portion to a threaded projection portion.

21. The attachment unit according to claim 20, wherein the article to which the attachment unit is to be attached is a camera or a video camera.

22. The attachment unit according to claim 21, wherein the first portion of the attachment unit can be screw-fitted onto the screw of the article, the screw of the article being provided at the article for connecting a tripod to the article.

* * * * *